United States Patent [19]

Berry

[11] Patent Number: 4,968,037

[45] Date of Patent: Nov. 6, 1990

[54] PUTTER ATTACHABLE HOLDER FOR BALL POSITION MARKER

[76] Inventor: William J. Berry, 498 Franklin La., Elk Grove Village, Ill. 60007

[21] Appl. No.: 351,057

[22] Filed: May 12, 1989

[51] Int. Cl.[5] ..... A63B 53/00

[52] U.S. Cl. ..... 273/162 D; 224/918; 221/58; 221/279; 273/32 A

[58] Field of Search ..... 453/50, 51, 52, 53, 453/54; 221/58, 279; 273/32 A, 162 D, 32 R, 32 B, 32 H; 224/918

[56] References Cited

U.S. PATENT DOCUMENTS 306,032 9/1884 Pine ..... 453/54
846,683 3/1907 Moore et al. ..... 221/283
3,604,562 9/1971 Loeffler ..... 221/279
4,239,216 12/1980 Bauer ..... 273/32 A
4,767,022 8/1988 Oldorf ..... 221/283

*Primary Examiner*—George J. Marlo
*Attorney, Agent, or Firm*—Wood, Phillips, Mason, Recktenwald & VanSanten

[57] ABSTRACT

A greens marker holder adapted for affixation to the end of a putter by an adhesive. The holder includes a housing in which is mounted a cover biased upwardly by a resilient body retained in the internal space of the holder housing by a lower closure. A partial top wall is adapted for the provision of an indicium thereon. The holder is secured to the upper end of a golf club by a sheet element having a lower adhesive layer for engagement with the top end of the golf club.

9 Claims, 1 Drawing Sheet

FIG. 1
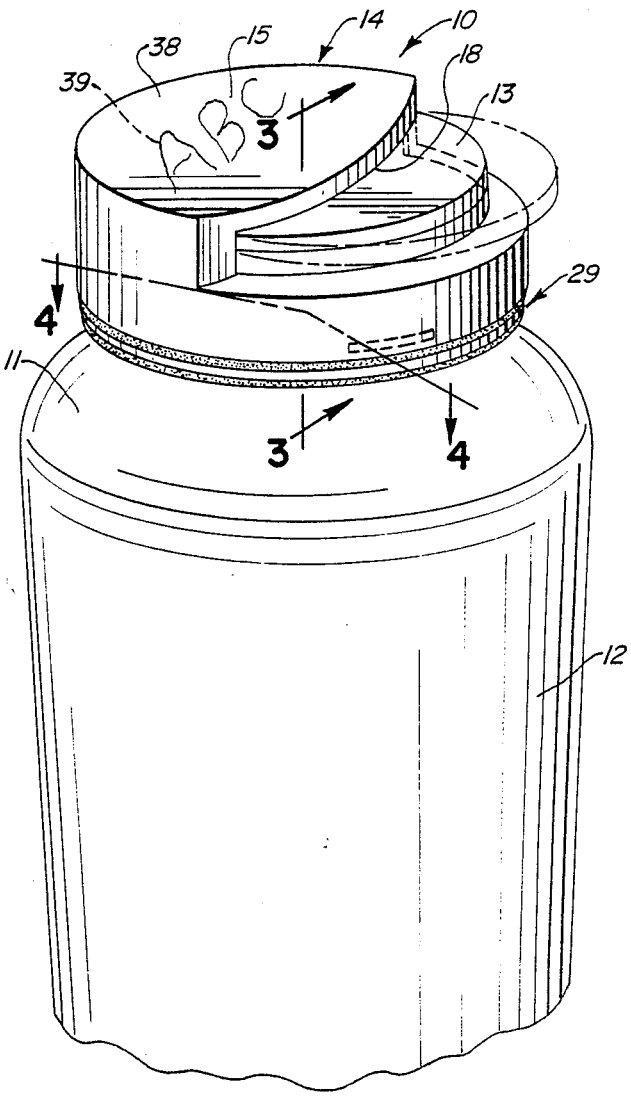
FIG. 2
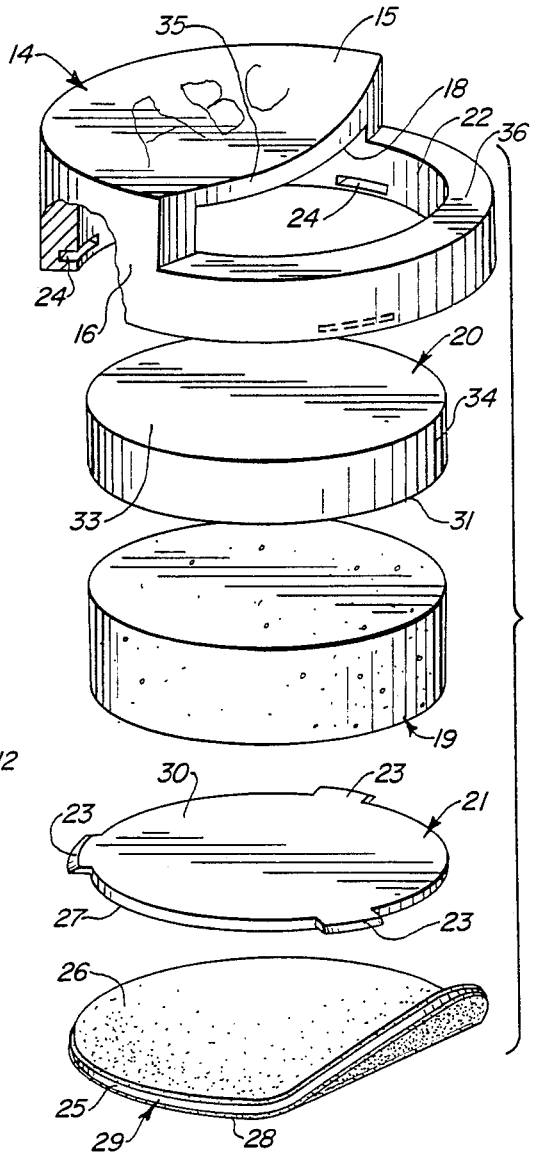
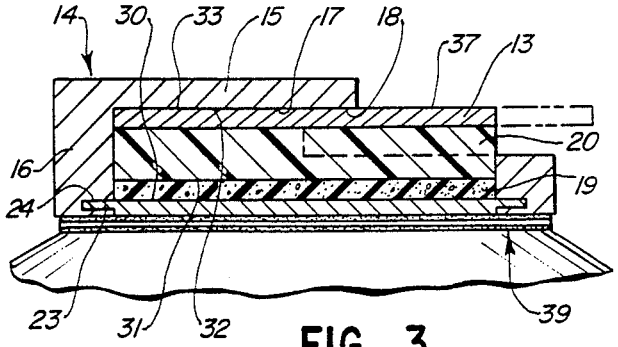
FIG. 3
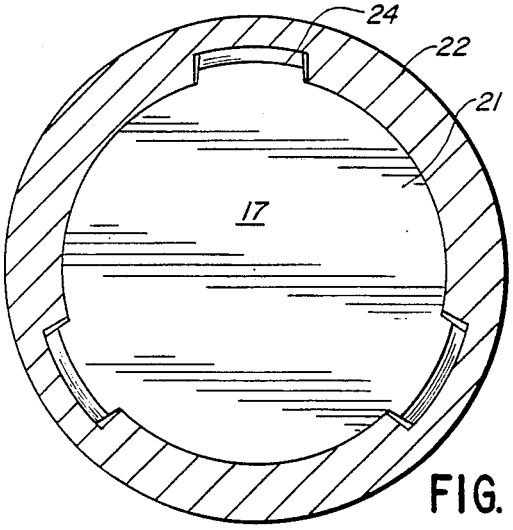
FIG. 4

PUTTER ATTACHABLE HOLDER FOR BALL POSITION MARKER

TECHNICAL FIELD

This invention relates to golfing accessories and in particular to a holder for a greens marker adapted to be mounted to the end of a putter.

BACKGROUND ART

A number of devices have been developed for storing and dispensing a coin for use as a greens marker in playing the game of golf. It is known to provide such devices to be removably installed on the end of the putter by expandable means adapted to provide a removable affixation of the device to the end of the putter.

The known devices utilize a biasing support within the holder for removably holding the desired greens marker coin against the underside of an overhanging ledge with an exposed portion of the coin's upper surface being engageable by the user's finger to slide it from the holder when desired.

The support is biased upwardly by a coil spring which conventionally has sufficient strength to maintain the coin in the holder against the undersurface of the overlying ledge while yet permitting withdrawal and replacement of the coin relative to the holder as desired.

The prior art structure has a serious disadvantage of variability in the biasing force of different springs. Where the spring force is excessively high, it is difficult to withdraw and replace the marker in the device. Alternatively, where the spring force is excessively low, it is deficient to properly hold the marker in place against dislodgement due to vibration and jostling in the transportation and use of the club.

DISCLOSURE OF THE INVENTION

The present invention comprehends an improved greens marker holder which eliminates the disadvantages of the above discussed prior art structures in a novel and simple manner.

More specifically, the invention comprehends the provision of such a greens marker holder including a housing having an upper wall and a sidewall, the walls cooperatively defining an internal space and an opening to the space for permitting selective reception therein and withdrawal therefrom, immediately subjacent the upper wall of the housing, of a greens marker by edgewise movement thereof through the opening.

The holder further includes a body of resiliently compressible material in the housing space and a cover overlying the body for slidable engagement by the greens marker during insertion and withdrawal movement through the opening.

The holder further includes a closure mounted to a lower portion of the sidewall for closing the housing space at a lower end thereof. The resilient body has an uncompressed height greater than the spacing between the closure and the cover when the cover is urged by the body upwardly against the upper wall of the housing whereby a greens marker received in the opening to extend flatwise between the upper wall and the cover is yieldably retained therebetween by the force of expansion of the resilient body.

The holder further includes means associated with a closure for mounting the holder to the end of a golf club such as a putter.

In the illustrated embodiment, the cover includes a depending peripheral wall enclosing an upper portion of the resiliently compressible body, the cover being slidably fitted in the housing sidewall.

In the illustrated embodiment, the body is formed of sponge material.

In the illustrated embodiment, the upper wall overlies a major portion of the area transversely across the upper end of the housing space.

Illustratively, the upper wall ma be provided with an indicium, such as an advertising slogan or the like.

In the illustrated embodiment, the closure and the lower portion of the sidewall cooperatively define retaining means for removably retaining the closure in the housing.

In the illustrated embodiment, the height of the cover peripheral wall is greater than the height of the opening through the sidewall of the housing.

Illustratively, the upper wall may define a convex edge surface overlying the space.

In the illustrated embodiment, the housing sidewall is right circularly cylindrical.

The invention comprehends that the means for mounting the holder to the end of the golf club may comprise adhesive means. In the illustrated embodiment the means for mounting the holder to the end of the golf club includes a sheet element having adhesive means on the bottom surface thereof and adhesive means securing the sheet element to the bottom surface of the closure.

The greens marker holder of the present invention is extremely simple and economical of construction while yet providing the highly desirable features discussed above.

BRIEF DESCRIPTION OF THE DRAWINGS

Other features and advantages of the inventional will be apparent from the following description taken in connection with the accompanying drawing wherein:

FIG. 1 is a fragmentary perspective view illustrating the mounting of a greens marker holder embodying the invention on the upper end of a golf club;

FIG. 2 is a fragmentary perspective exploded view of the green marker holder;

FIG. 3 is an enlarged fragmentary vertical section taken substantially along the line 3—3 of FIG. 1; and FIG. 4 is a transverse section taken substantially along the line 4—4 of FIG. 1.

BEST MODE FOR CARRYING OUT THE INVENTION

In the illustrative embodiment of the invention as disclosed in the drawing, a greens marker holder generally designated 10 is shown as mounted to the end 11 of a golf club, such as putter 12. The greens marker holder is adapted for removably retaining a greens marker generally designated 13 in the form of a disclike object adapted to be placed on the green when the player's ball is removed temporarily. The marker may comprise a conventional coin or any other suitable disc element as desired.

The holder includes an outer housing generally designated 14 having an upper wall 15 and a sidewall 16. The upper wall and sidewall cooperatively define an internal space 17 and an opening 18 to space 17 for permitting selective reception in and withdrawal from the space immediately subjacent the upper wall 15 of the greens marker 13 by edgewise movement thereof through the opening 18.

The holder further includes a cylindrical body 19 of resiliently compressible material, such as sponge material.

A cylindrical cover 20 is provided in overlying relationship to the resilient body for slidable engagement by the greens marker 13 during insertion and withdrawal movement thereof through the opening 18. Illustratively, the cover may be formed of synthetic resin, metal, etc.

The holder further includes a closure member 21 secured to a lower portion 22 of the holder sidewall 16 for closing the bottom of the space 17.

In the illustrated embodiment, the closure is provided with a plurality of radially outwardly extending tabs 23 adapted to be snap-fitted into suitable recesses 24 in the sidewall lower portion 22. As will be obvious to those skilled in the art, any other suitable means for securing the closure to the housing lower sidewall portion may be utilized within the broad scope of the invention.

The invention further comprehends the provision of means generally designated 29 for mounting the holder to the end 11 of the golf club in the form of a sheet element 25 having an upper adhesive layer 26 for adhering the sheet element to the bottom surface 27 of the closure, and a lower adhesive layer 28 for adhering the sheet element 25 to the upper surface of the club end 11. Suitable adhesives for substantially permanently affixing the holder to the club end are well known in the art and any suitable adhesive adapted for this purpose may be utilized within the broad scope to the invention. Mounting means 29, comprising the sheet element 25 and adhesive layers 26 and 28, has been found to comprise a particularly advantageous means for securing the holder to the golf club end as it permits facilitated installation while yet providing positive retention of the holder on the golf club as long as the user wishes.

Conventionally, such adhesive surfaces may be provided with a removable cover sheet preventing adhesion thereof until the cover sheet is removed, thereby permitting the user to affix the holder to the golf club end upon removal thereof.

The resilient body 19 preferably has an uncompressed height greater than the spacing between the upper surface 30 of the closure and the lower surface 31 of the cover 20 when the cover is urged against the undersurface 32 of the upper wall 15 in the absence of the greens marker 13 in the holder. Thus, when the greens marker is received in the opening to extend flatwise between the upper wall bottom surface 32 and the upper surface 33 of the cover 20 as seen in FIG. 3, the marker is yieldably retained therebetween by the force of expansion of the resilient body 19.

The cover 20 preferably has a height greater than the height of the lateral opening 18 so that the bottom surface 31 of the cover is maintained within the lower portion 22 of the sidewall at all times including when the greens marker 13 is removed from the holder.

The cylindrical peripheral wall 34 of the closure preferably has sliding fit with the inner surface of the housing sidewall lower portion 22 for facilitated movement thereof and biasing the greens marker 13 upwardly against the lower surface 32 of the top wall when the greens marker is disposed within the holder.

Upper wall 15, as seen in FIGS. 1, 2 and 3, extends less than fully across the space 17 whereby a portion of the upper surface of the greens marker 13 is exposed at all times for digital engagement by the user in removing the greens marker from the holder and reinstalling the greens marker in the holder as desired. In the illustrated embodiment, the upper wall extends over slightly more than one-half of the cross-sectional area of the space 17. The wall defines a peripheral edge 35 extending substantially inwardly from the upper front edge surface 36 of the housing sidewall portion 22 so as to expose a substantial outer area of the space 17 and thus a substantial area of the upper surface 37 of the marker 13 when installed in the holder.

Upper surface 38 of the upper wall may be provided with an indicium 39 which illustratively may comprise an advertising logo, advertisement message, decorative effect, etc. In the illustrated embodiment, the edge surface 35 is convex whereby the top surface 38 of the upper wall is generally oval and the access to space 17 upwardly of edge surface 35 is generally crescent-shaped.

Housing 14 and closure 21 may be formed of suitable synthetic resin for improved long life and low cost.

A greens marker holder embodying the invention found to provide improved availability and mounting was constructed to have a height of 0.26 inches for use with a greens marker having a height of 0.1 inches. The inner diameter of the housing was $\frac{7}{8}$ of an inch and the height of the opening was 0.1 inch.

The diameter of the cover was 27/32 inches and the height of the cover was 0.15 inches. The height of the uncompressed resilient sponge body was 0.3 inches and the diameter of the sponge was $\frac{3}{4}$ of an inch.

The tabs had a radial extension of 1/32 of an inch.

The greens marker holder of the invention is extremely simple and economical of construction, readily mountable on the end of a putter, and provides long troublefree, removable retention of the greens marker at the upper end of the putter without interfering with the normal use of the putter. In the prior art devices where the securing means extends about the upper end of the cover, interference with the user's unrestricted use of the putter handle is precluded. By mounting the greens marker holder on the upper end of the putter, such interference is effectively precluded. By virtue of the small size and in particular the small height of the greens marker holder of the present invention, normal use of the putter may be had while yet assuring that the greens marker is always available to the user when needed.

The foregoing disclosure of specific embodiments is illustrative of the broad inventive concepts comprehended by the invention.

I claim:

1. A greens marker holder having a height sufficiently small to enable the holder to be secured to the upper end of a putter without interfering with the normal use thereof and comprising:

a housing having an upper wall, and a sidewall, said walls cooperatively defining an internal space and a lateral opening to said space for permitting selective reception in and withdrawal from said space immediately subjacent said upper wall of a greens marker by edgewise movement of the greens marker through said opening, said upper wall overlying a major portion of the area transversely across an upper end of said space;

a body of resiliently compressible sponge material in said space;

a cover overlying said body for slidable engagement by the greens marker during insertion and withdrawal movement through said opening;

a closure mounted to a lower portion of said sidewall for closing said space, said body having an uncompressed height greater than the spacing between said closure and said cover when said cover is urged by said body upwardly against the upper wall of the housing whereby a greens marker received in said opening to extend flatwise between said upper wall and said cover is yieldably retained therebetween by the force of expansion of said body; and means associated with said closure for mounting said holder to the end of a golf club comprising a sheet element having adhesive means on the bottom surface thereof and adhesive means securing the sheet element to a bottom surface of the closure.

2. The greens marker holder of claim 1 wherein said cover has a height greater than the height of said opening to said space.

3. The greens marker holder of claim 1 wherein said cover defines a peripheral wall slidably fitted in said housing sidewall.

4. The greens marker holder of claim 1 wherein said upper wall is provided with an indicium.

5. The greens marker holder of claim 1 wherein said closure and lower portion of said sidewall define cooperating retaining means for removably retaining the closure to the housing.

6. The greens marker holder of claim 1 wherein said closure and lower portion of said sidewall define a plurality of cooperating recess and projection means for removably retaining the closure to the housing.

7. The greens marker holder of claim 1 wherein said cover defines a peripheral wall slidably fitted in said housing sidewall, the height of said cover peripheral wall being greater than the height of said opening through said sidewall.

8. The greens marker holder of claim 1 wherein said upper wall defines a convex edge surface overlying said space.

9. The greens marker holder of claim 1 wherein said housing sidewall is right-circularly cylindrical.

* * * * *